US008186260B2

(12) United States Patent
Martin et al.

(10) Patent No.: US 8,186,260 B2
(45) Date of Patent: May 29, 2012

(54) TRANSLATING ADJACENT-BLAST SHIELD AND METHOD FOR PROTECTING EXTERNAL SLOTS OF MISSILES IN LAUNCHER TUBES

(75) Inventors: Robert Wade Martin, Tucson, AZ (US); Philip Scott Rice, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 92 days.

(21) Appl. No.: 12/938,906

(22) Filed: Nov. 3, 2010

(65) Prior Publication Data

US 2012/0103175 A1 May 3, 2012

(51) Int. Cl.
*F41F 3/04* (2006.01)

(52) U.S. Cl. ..... 89/1.8; 89/1.816

(58) Field of Classification Search ..... 89/1.8, 89/1.804, 1.815, 1.816, 1.819, 36.01; 102/347, 102/349; 244/3.24, 3.26, 3.3
See application file for complete search history.

(56) References Cited

U.S. PATENT DOCUMENTS

| | | | | |
|---|---|---|---|---|
| 3,038,382 | A * | 6/1962 | Noyes et al. | 89/1.816 |
| 4,203,347 | A * | 5/1980 | Pinson et al. | 89/1.816 |
| 4,393,745 | A * | 7/1983 | Mayo et al. | 89/1.806 |
| 4,616,554 | A * | 10/1986 | Spink et al. | 89/1.806 |
| 4,756,226 | A * | 7/1988 | Piesik | 89/1.8 |
| 5,398,588 | A * | 3/1995 | Peck | 89/1.806 |
| 5,902,952 | A * | 5/1999 | DelGuidice et al. | 89/1.819 |
| 6,755,111 | B2 * | 6/2004 | Ciappi | 89/1.817 |
| 6,971,300 | B2 * | 12/2005 | Kunstmann | 89/1.816 |

* cited by examiner

*Primary Examiner* — Bret Hayes
(74) *Attorney, Agent, or Firm* — Schwegman, Lundberg & Woessner, P.A.; Gregory J. Gorrie

(57) ABSTRACT

Embodiments of a translating adjacent-blast shield and method of protecting external slots of a missile from a high-temperature, high-pressure gas plume of a missile that is launched from an adjacent or nearby launcher tube of a launcher are disclosed herein. The translating adjacent-blast shield may be provided circumferentially around each of the missiles in a launcher and may cover at least portions of external slots of the missiles. The translating adjacent-blast shield may translate along the missile during launch to expose the external slots and may remain on the missile after launch.

20 Claims, 4 Drawing Sheets

TRANSLATING ADJACENT-BLAST SHIELD AND METHOD FOR PROTECTING EXTERNAL SLOTS OF MISSILES IN LAUNCHER TUBES

TECHNICAL FIELD

Embodiments pertain to weapons systems that use launchers containing closely-spaced weapons. Some embodiments pertain to missile systems that include several rockets or missiles that are launched from a launcher tube.

BACKGROUND

Weapon systems often include several closely-spaced rockets or missiles that are individually launched from a launcher. These rockets or missiles may have external slots that contain equipment such as canards, sensors or antennas. Because these rockets or missiles are closely spaced in the launcher, the high-temperature, high-pressure gas plume and other debris (ejecta) generated by the launch of an adjacent or nearby rocket or missile may damage these slots and/or the equipment in the slots while the rocket or missile is still in the launcher.

Frangible covers that are fractured during deployment of canards have been used to protect these slots; however, the energy to fracture a frangible cover complicates the operation of the deployment mechanism. Furthermore, debris from the fractured covers may cause concern with some airborne applications.

Elastomer film covers have also been used to protect these slots; however, elastomer film is not able to withstand the high-temperature, high-pressure gas plume and other debris of an adjacent launch. Ablative shielded film covers have also been used; however, the shields require excessive penetration energy, complicating the operation of the deployment mechanism.

Thus, there are general needs for apparatus and methods for protecting external slots of rockets and missiles from the high-temperature, high-pressure gas plume and other debris generated from the launch of an adjacent or nearby rocket or missile.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1A:
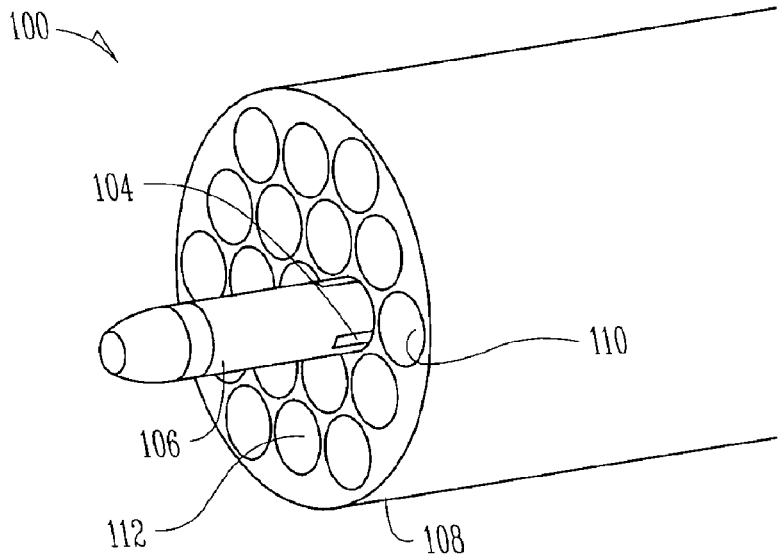
FIG. 1A illustrates a weapons system including a missile with an exposed external slot.

FIG. 1A illustrates a weapons system including a missile with an exposed external slot. Weapons system 100 includes a launcher 108 having a plurality of launcher tubes 112 and a plurality of missiles 106 (only one of which is illustrated for clarity). Each missile 106 may be provided within one of the launcher tubes 112 and may include one or more external slots 104. The high-temperature, high-pressure gas plume and other debris (ejecta) generated by the launch of a missile from an adjacent or nearby launcher tube 110 may damage these slots 104 and/or the equipment in these slots 104 while the missile 106 is in the launcher 108.

Figure 1B:
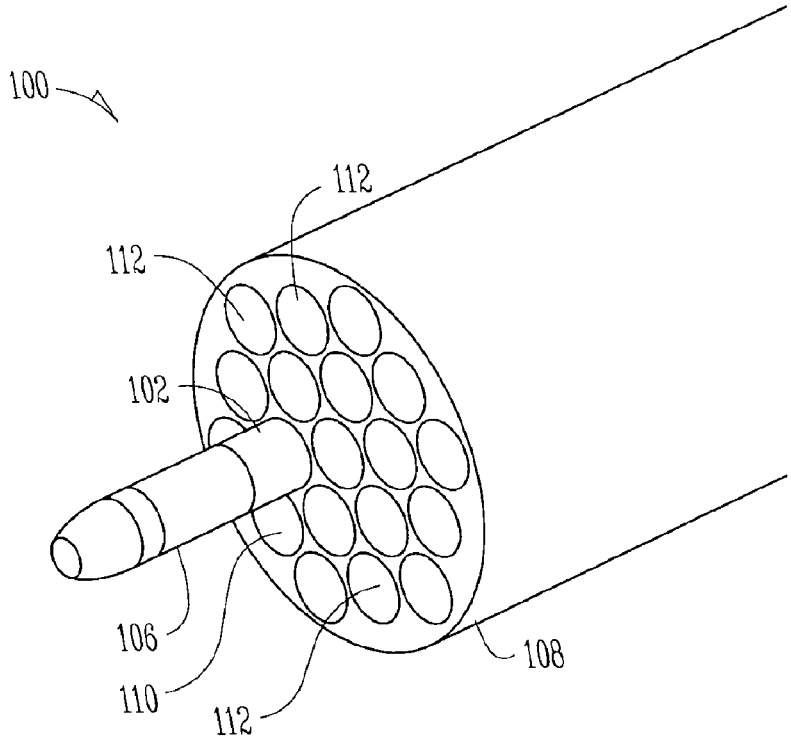
FIG. 1B illustrates the weapons system of FIG. 1A, including a missile with a translating adjacent-blast shield, in accordance with some embodiments.

FIG. 1B illustrates the weapons system 100 of FIG. 1A, including a missile with a translating adjacent-blast shield 102, in accordance with some embodiments. As illustrated in FIG. 1B, the translating adjacent-blast shield 102 is provided circumferentially around the missile 106 and covers at least portions of the external slots 104 (FIG. 1A) of the missile 106. For clarity, only one missile 106 and one translating adjacent-blast shield 102 is shown. The translating adjacent-blast shield 102 is configured to protect the external slots 104 of the missile 106 from a high-temperature, high-pressure gas plume of an adjacent missile launch (i.e., a missile launched from an adjacent or nearby launcher tube 110). The translating adjacent-blast shield 102 is configured to translate along the missile 106 during launch to expose the external slots 104 and remain on the missile 106 after launch. These embodiments are described in more detail below.

In accordance with some embodiments, friction holds the translating adjacent-blast shield 102 within the launcher tube 112 prior to launch and initially during launch of a missile 106. As the missile 106 is propelled from the launcher 108 during launch, the external slots 104 are exposed and the translating adjacent-blast shield 102 may catch on a split ring to hold the translating adjacent-blast shield 102 in place during deployment of the missile 106. These embodiments are described in more detail below.

In some embodiments, the external slots 104 are canard slots from which canards may be deployed after launch, although the scope of the embodiments is not limited in this respect. In other embodiments, the external slots 104 may be sensor openings to allow operation of one or more sensors after launch. The sensors may include antennas, cameras, infrared (IR) sensors, ultraviolet (UV) light sensors, visible light sensors, as well as others.

As used herein, an adjacent or nearby missile may refer to any other missile in the launcher 108. A missile may include any flight vehicle or rocket including a guided as well as an unguided projectile. In some embodiments, the external slots 104 may have covers that may comprise a thin film or other material (e.g., an elastomer). In these embodiments, the translating adjacent-blast shield 102 may protect the slot covers from a high-temperature, high-pressure gas plume as well as ejecta resulting from the launch of an adjacent missile.

In some embodiments, a method for protecting external slots of a missile from a high-temperature, high-pressure gas plume of an adjacent missile launch is provided. In these embodiments, the method may include providing a translating adjacent-blast shield 102 circumferentially around each of a plurality of missiles 106 in the launcher 108 to cover at least portions of the external slots 104 of the missiles 106. The translating adjacent-blast shield 102 may be configured to protect the external slots 104 of the missile 106 from a high-temperature, high-pressure gas plume, as well as other ejecta, of an adjacent missile launch. The method may include allowing the translating adjacent-blast shield 102 to slide or translate along the missile 106 during its launch to expose the external slots 104 and remain on the missile 106 after launch.

Figure 2:
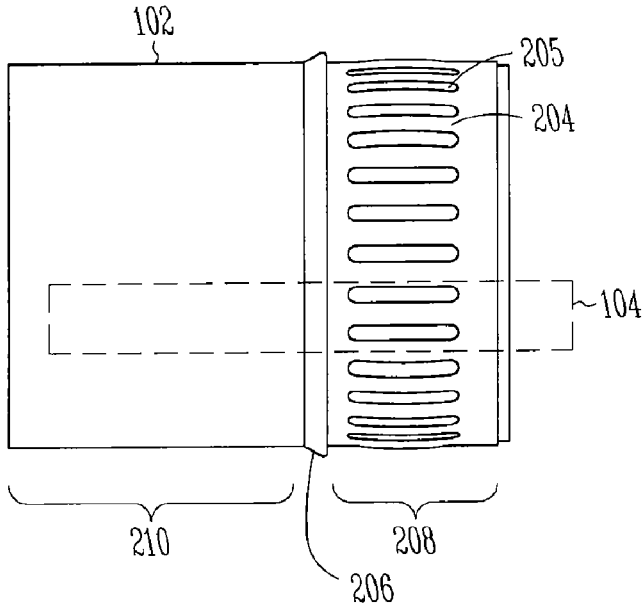
FIG. 2 is a side view of a translating adjacent-blast shield in accordance with some embodiments.

FIG. 2 is a side view of a translating adjacent-blast shield 102 in accordance with some embodiments. The translating adjacent-blast shield 102 may include an aft portion 208 comprising a plurality of spring fingers 204 provided circumferentially. The spring fingers 204 may be configured to create friction with an inner surface of a launcher tube 112 (FIG. 1B) when inserted into the launcher tube 112. The translating adjacent-blast shield 102 may also include a forward portion 210 and a position stop 206. The position stop 206 may be provided between the forward portion 210 and the aft portion 208 to inhibit the forward portion 210 of the translating adjacent-blast shield 102 from being inserted into the launcher tube 112.

The translating adjacent-blast shield 102 may be positioned circumferentially around a missile 106 (FIG. 1B) and at least partially over the external slots 104 of the missile 106 when the missile 106 resides in the launcher tube 112 prior to launch. The forward portion 210 is positioned external to the launcher tube 112 to protect the external slots 104 from a high-temperature, high-pressure gas plume of an adjacent missile. An example position of an external slot 104 when the missile 106 resides in the launcher tube 112 prior to launch is illustrated in FIG. 2 by a dashed-line. In this example, the external slot 104 extends beyond the length of the translating adjacent-blast shield 102, although this is not a requirement.

In these embodiments, the translating adjacent-blast shield 102 provides a full circumferential shield for the external slots 104. The forward portion 210 is located outside the launcher tube 112 prior to launch while the aft portion 208 is located within the launcher tube 112. As show in FIG. 1B, only the forward portion 210 of the translating adjacent-blast shield 102 is actually shown as the aft portion 208 is located within the launcher tube. The aft portion 208 protects the external slots 104 from the high-temperature, high-pressure gas plume of an adjacent or nearby missile during launch of the adjacent or nearby missile.

The position stop 206 may comprise a raised lip to inhibit the forward portion 210 of the translating adjacent-blast shield 102 from being further inserted into a launcher tube 112. In these embodiments, the position stop 206 has a diameter greater than the diameter of a launcher tube 112. The aft portion 208, including the spring fingers 204, may be specifically configured for insertion into the launcher tube 112.

As further illustrated in FIG. 2, finger slots 205 may reside between the fingers 204. In some embodiments, the position stop 206 may provide a launch-tube seal to inhibit debris from entering the launcher tube 112 prior to launch. The debris, for example, may result from natural occurring environmental exposure. The position stop 206 may also provide some protection for portions of the external slots 104 that reside within the launcher tube 112 from a high-temperature, high-pressure gas plume resulting from the launch of an adjacent or nearby missile.

In embodiments with closely-spaced missiles, the translating adjacent-blast shield 102 may be installed on the missiles 106 prior to installation of a missile 106 into the launcher 108. In other embodiments, when there is more available space between the missiles 106, the translating adjacent-blast shield 102 may be installed on the missiles 106 while the missiles 106 reside in the launcher 108. In these embodiments, the translating adjacent-blast shield 102 may be slid over the nose of a missile 106 and the aft portion 208 may be pressed into the launcher tube 112 until the position stop 206 contacts the launcher tube 112.

Figure 3:
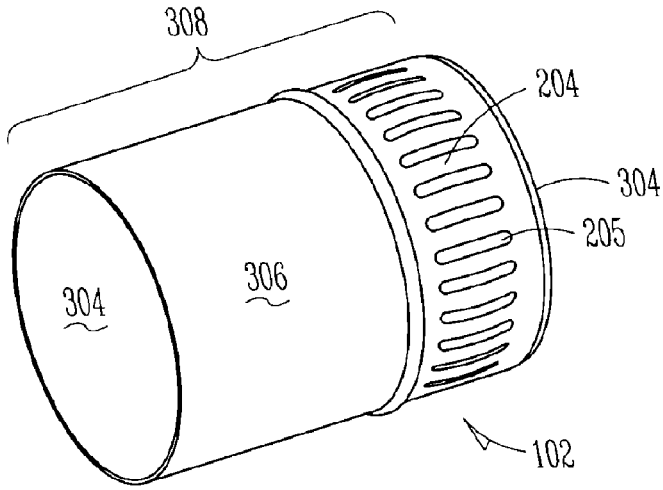
FIG. 3 is a perspective view of the translating adjacent-blast shield of FIG. 2 in accordance with some embodiments.

FIG. 3 is a perspective view of the translating adjacent-blast shield of FIG. 2 in accordance with some embodiments. As illustrated in FIG. 3, the translating adjacent-blast shield 102 may include an inner shell 304 and an outer shell 306. The plurality of spring fingers 204 may be formed from the outer shell 306. The inner shell 304 may extend the full length 308 of the translating adjacent-blast shield 102 and may seal the finger slots 205 (i.e., from the inside). This may inhibit a high-temperature, high-pressure gas plume from an adjacent missile from entering through the finger slots 205.

In some embodiments, the inner shell 304 and the outer shell 306 comprise metal such as steel, stainless steel or an alloy of steel, although titanium and other materials may be used. The material may be selected to withstand the high-temperature, high-pressure gas plume of an adjacent missile launch. For example, a material that has a capability of momentarily withstanding the high-temperature, high-pressure gas plume may be used. In some embodiments, the material may comprise 17-4 stainless steel or 4140 steel, although the scope of the embodiments is not limited in this respect.

In some embodiments, the finger slots 205 may be fabricated in the outer shell 306 by a machining process or by a punching process leaving fingers. These fingers may be raised to provide the spring fingers 204 by compressing the end of the outer shell 306 until a desired finger height is achieved.

In some embodiments, the inner shell 304 and the outer shell 306 of the translating adjacent-blast shield 102 may each comprise a separate metal layer. In some embodiments, the inner shell 304 and the outer shell 306 may be spot welded together and may be a two-piece rolled-formed construction. In some alternate embodiments, a single metal layer may be used.

The parameters of the aft portion 208 including a width, height and spacing of the spring fingers 204 may be selected or tuned to provide an amount of friction to initially retain the translating adjacent-blast shield 102 within the launcher tube 112 and to allow the translating adjacent-blast shield 102 to be inserted into the launcher tube 112 by a single human. In these embodiments, other parameters such as a slot width of the finger slots 205, the material thickness and the material type may also be selected to provide a predetermined amount of friction. In these embodiments, the predetermined amount of friction may also be selected to allow the translating adjacent-blast shield 102 to be pulled from the launcher tube 112 by the missile 106 during launch after sliding onto a split ring.

Figure 4:
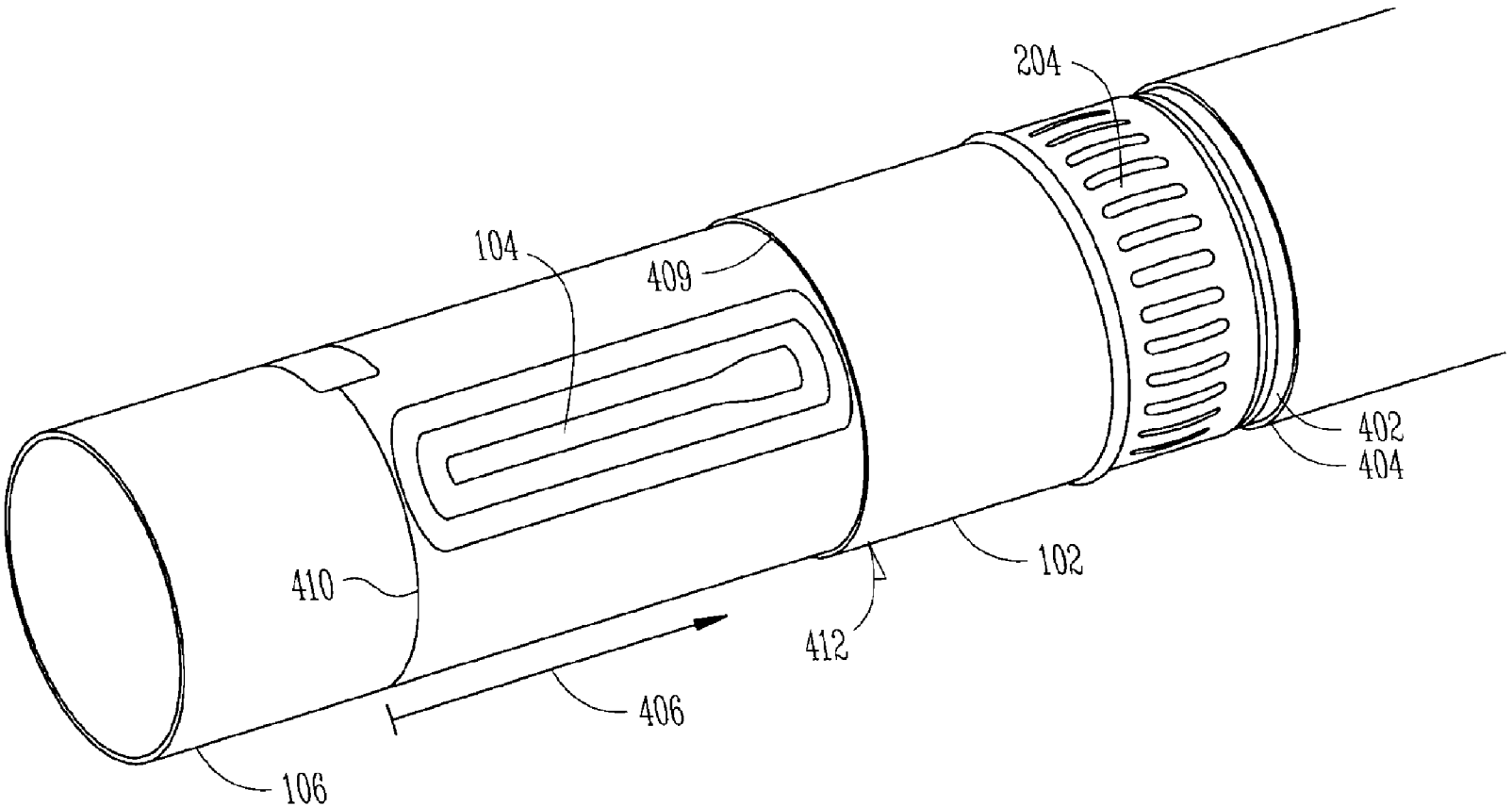
FIG. 4 illustrates the operation of a translating adjacent-blast shield in accordance with some embodiments.

FIG. 4 illustrates the operation of a translating adjacent-blast shield in accordance with some embodiments. During launch, the friction caused by the fingers 204 within the launcher tube 112 (FIG. 1B) initially retains the aft portion 208 (FIG. 2) of the translating adjacent-blast shield 102 within the launcher tube 112 (FIG. 1B) as the translating adjacent-blast shield 102 slides (i.e., translates) along the missile body in aft direction 406 as the missile 106 moves forward in the launch tube at launch (i.e., in a direction opposite the aft direction 406) to expose the external slots 104. After exposure of the external slots 104, the translating adjacent-blast shield 102 is configured to further slide onto a forward-tapered split ring 402 to inhibit further aft movement of the translating adjacent-blast shield 102. In these embodiments, the forward-tapered split ring 402 may be provided circumferentially around the missile 106 in front of a ledge 404 or within a recess. The diameter of the translating adjacent-blast shield 102 may be slightly greater than the diameter of the missile 106 to allow the translating adjacent-blast shield 102 to slide in the aft direction 406 with little or no friction.

Accordingly, the external slots 104 are not only protected from a high-temperature, high-pressure gas plume of an adjacent or nearby missile during launch of the adjacent or nearby missile, the external slots 104 are also exposed during launch. According, if the external slots 104 are canard slots, after launch, canards may deploy from the external slots 104. In some embodiments, each missile may include three or four canards, although the scope of the embodiments is not limited in this respect. In some embodiments, the canards may comprise flight surfaces including controllable flight surfaces to allow the flight of the rocket or missile 106 to be guided or controlled.

As illustrated in FIG. 4, the forward edge 409 of the translating adjacent-blast shield 102 may initially be at location 410 when the missile 106 and the translating adjacent-blast shield 102 reside in the launcher tube 112. After launch, the forward edge 409 of the translating adjacent-blast shield 102 may translate from location 410 to location 412, exposing the external slots 104.

In these embodiments, the translating adjacent-blast shield 102 is configured to be held in place by the forward-tapered split ring 402 after launch and travel with the missile 106 during flight. The forward-tapered split ring 402 may be a spring ring and may be provided circumferentially around the missile 106 in front of a ledge 404 or within a recess as illustrated in FIGS. 4 and 5.

In some alternate embodiments, instead of a forward-tapered split ring 402, other elements, such as a raised ridge, may be used to hold the translating adjacent-blast shield 102 in place after launch.

Figure 5:
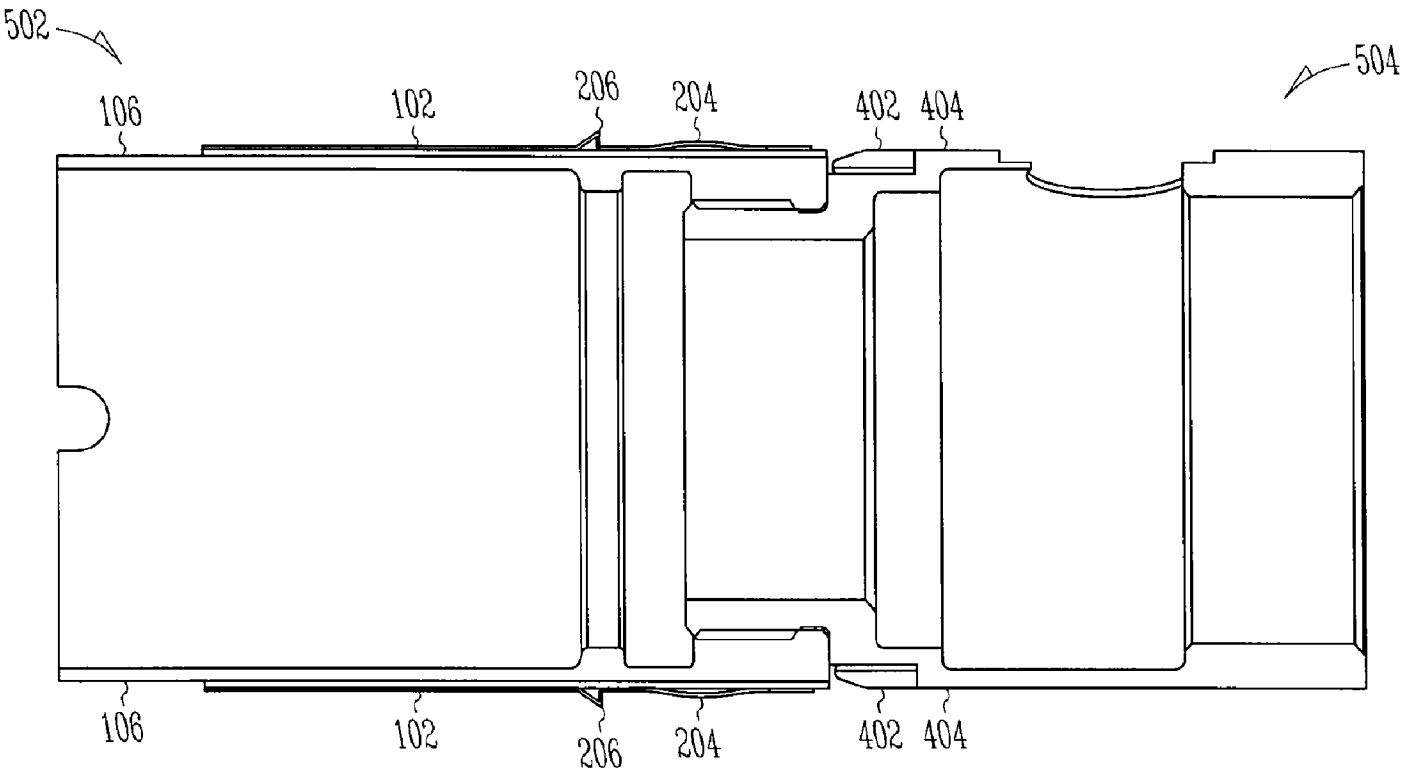
FIG. 5 is a cross-sectional view of the translating adjacent-blast shield located on a missile in accordance with some embodiments.

FIG. 5 is a cross-sectional view of the translating adjacent-blast shield 102 located on a missile 106 in accordance with some embodiments. The missile 106 may include a guidance section 502 and an adapter 504. The adapter 504 may allow the guidance section 502 to be adapted to a particular missile or warhead. As shown in FIG. 5, the translating adjacent-blast shield 102 includes a plurality of spring fingers 204 and the position stop 206. During launch, the translating adjacent-blast shield 102 is configured to slide onto the forward-tapered split ring 402 to inhibit further aft movement of the translating adjacent-blast shield 102. The forward-tapered split ring 402 may be provided circumferentially around the missile 106 in front of a ledge 404 (as illustrated) or within a recess.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the Detailed Description, with each claim standing on its own as a separate embodiment.

What is claimed is:

1. A translating adjacent-blast shield to shield external slots of a missile from a high-temperature, high-pressure gas plume of an adjacent missile when an adjacent missile is launched from an adjacent or nearby launcher tube of a launcher, the translating adjacent-blast shield comprising:

an aft portion comprising a plurality of spring fingers provided circumferentially, the spring fingers to create friction with an inner surface of a launcher tube when inserted into the launcher tube;

a forward portion; and a position stop provided between the forward portion and the aft portion to inhibit the forward portion of the translating adjacent-blast shield from being inserted into the launcher tube.

2. The translating adjacent-blast shield of claim 1 wherein the translating adjacent-blast shield is positioned circumferentially around a missile and at least partially over the external slots of the missile when the missile resides in the launcher tube prior to launch, and wherein the forward portion is positioned external to the launcher tube to protect the external slots from a high-temperature, high-pressure gas plume of an adjacent missile.

3. The translating adjacent-blast shield of claim 1 wherein the position stop comprises a raised lip to inhibit the forward portion of the translating adjacent-blast shield from being further inserted into the launcher tube.

4. The translating adjacent-blast shield of claim 3 wherein the position stop provides a launch-tube seal to inhibit debris from entering the launcher tube prior to launch.

5. The translating adjacent-blast shield of claim 1 wherein during launch, the friction caused by the spring fingers within the launcher tube is to initially retain the aft portion of the translating adjacent-blast shield within the launcher tube as the translating adjacent-blast shield slides in an aft direction with respect to the missile to expose the external slots, and wherein after exposure of the external slots, the translating adjacent-blast shield is configured to further slide onto a forward-tapered split ring to inhibit further aft movement of the translating adjacent-blast shield.

6. The translating adjacent-blast shield of claim 5 wherein after launch, the translating adjacent-blast shield is configured to be held in place by the forward-tapered split ring and travel with the missile during flight.

7. The translating adjacent-blast shield of claim 5 wherein parameters of the aft portion including a width, height and spacing of the spring fingers are selected to provide an amount of friction to initially retain the aft portion of the translating adjacent-blast shield within the launcher tube and to allow the aft portion of the translating adjacent-blast shield to be inserted into the launcher tube by a human.

8. The translating adjacent-blast shield of claim 1 wherein the plurality of spring fingers, the forward portion, and the position stop comprise a metal, being one of steel, a stainless steel or an alloy of steel.

9. The translating adjacent-blast shield of claim 1 wherein the translating adjacent-blast shield includes an inner shell and an outer shell, wherein the plurality of spring fingers are formed from the outer shell, and wherein the inner shell extends a length of the translating adjacent-blast shield and seals finger slots.

10. A method for protecting external slots of a missile from a high-temperature, high-pressure gas plume of an adjacent missile launch, the method comprising:

providing a translating adjacent-blast shield circumferentially around each of a plurality of missiles and covering at least portions of external slots of the missiles, the translating adjacent-blast shield configured to protect the external slots of the missile from a high-temperature, high-pressure gas plume of an adjacent missile launch; and allowing the translating adjacent-blast shield to translate along the missile during launch to expose the external slots and remain on the missile after launch.

11. The method of claim 10 wherein the translating adjacent-blast shield comprises an aft portion comprising a plurality of spring fingers provided circumferentially, the spring fingers to create friction with an inner surface of a launcher tube when inserted into the launcher tube, a forward portion, and a position stop provided between the forward portion and the aft portion to inhibit the forward portion of the translating adjacent-blast shield from being inserted into the launcher tube.

12. The method of claim 11 wherein during launch, the friction caused by the spring fingers within the launcher tube is to initially retain the aft portion of the translating adjacent-blast shield within the launcher tube as the translating adjacent-blast shield slides along a missile body in an aft direction as the missile translates forward in the launch tube at launch to expose the external slots, and wherein after exposure of the external slots, the translating adjacent-blast shield is configured to further slide in the aft direction onto a forward-tapered split ring to inhibit further aft movement of the translating adjacent-blast shield.

13. A weapons system comprising:

a launcher having a plurality of launcher tubes;

a plurality of missiles, wherein each missile is provided within one launcher tube of the plurality of launcher tubes; and a translating adjacent-blast shield provided circumferentially around each of the missiles and covering at least portions of external slots of the missiles, wherein the translating adjacent-blast shield is configured to translate along an associated missile during launch to expose the external slots and remain on the associated missile after launch.

14. The weapons system of claim 13 wherein the translating adjacent-blast shield is configured to protect the external slots of the associated missile from a high-temperature, high-pressure gas plume of an adjacent missile launch.

15. The weapons system of claim 14 wherein friction holds the translating adjacent-blast shield within a launcher tube prior to launch and initially during launch.

16. The weapons system of claim 15 wherein the external slots are canard slots, and wherein canards are deployed from the external slots after launch.

17. The weapons system of claim 15 wherein the external slots are sensor openings to allow operation of one or more sensors after launch, and wherein the one or more sensors include at least one of an antenna, a camera, an infrared (IR) sensor, an ultraviolet (UV) light sensor, or a visible light sensor.

18. The weapons system of claim 15 wherein an aft portion of the translating adjacent-blast shield is configured for insertion into the launcher tube, wherein the translating adjacent-blast shield includes a forward portion that resides outside the launcher tube prior to launch, and wherein the aft portion has a plurality of spring fingers provided circumferentially, the spring fingers to create friction with an inner surface of a launcher tube, the forward portion being provided external to the launcher tube to protect the external slots from a high-temperature, high-pressure gas plume of an adjacent missile launch.

19. A system of flight vehicles wherein each flight vehicle is provided within one of a plurality of launcher tubes, wherein a translating adjacent-blast shield is provided circumferentially around each of the flight vehicles and covering at least portions of a sensor opening of the flight vehicles, and wherein the translating adjacent-blast shield is configured to translate along an associated flight vehicle during launch to expose the sensor opening and remain on the associated flight vehicle after launch.

20. The system of claim 19 wherein the translating adjacent-blast shield is configured to protect the external slots of the flight vehicles from a high-temperature, high-pressure gas plume resulting from launch of an adjacent or nearby flight vehicle, wherein the sensor openings allow operation of one or more sensors after launch, and wherein the one or more sensors include at least one of an antenna, a camera, an infrared (IR) sensor, an ultraviolet (UV) light sensor, or a visible light sensor.

* * * * *

UNITED STATES PATENT AND TRADEMARK OFFICE

CERTIFICATE OF CORRECTION

PATENT NO. : 8,186,260 B2
APPLICATION NO. : 12/938906
DATED : May 29, 2012
INVENTOR(S) : Martin et al.

It is certified that error appears in the above-identified patent and that said Letters Patent is hereby corrected as shown below:

On the Title Page, Item (56), under "U.S. Patent Documents", line 10, In the citation for U.S. PATENT "6,971,300 B2", after "6,971,300 B2 12/2005 Kunstmann 89/1.816", insert
--20060060715 A1 3/2006 Lundgren et al.
20060096449 A1 5/2006 Williams et al.
20090314270 A1 12/2009 Westmeyer et al.
3,674,227 7/1972 Jacobson et al.
3,742,814 7/1973 Kroh
4,134,327 1/1979 Piesik
4,134,328 1/1979 Asp et al.
4,243,290 1/1981 Williams
4,426,910 1/1984 Speer
4,433,606 2/1984 Hagelberg et al.
4,480,522 11/1984 Piesik
4,515,082 5/1985 Pizzurro
4,753,169 6/1998 Shores
4,934,241 6/1990 Piesik
5,003,883 4/1991 Mixon et al.
6,526,860 3/2003 Facciano et al.
FOREIGN PATENT DOCUMENTS
WO 0042375 A1 7/2000
OTHER PUBLICATIONS
"International Application Serial No. PCT/US2011/50336, International Search Report mailed Mar. 8, 2012", 3 pgs.
"International Application Serial No. PCT/US2011/50336, Written Opinion mailed Mar. 13, 2012", 4 pgs.--, therefor Signed and Sealed this
Twenty-sixth Day of February, 2013

Teresa Stanek Rea
*Acting Director of the United States Patent and Trademark Office*